US005495686A

United States Patent [19]

Millard et al.

[11] Patent Number: 5,495,686

[45] Date of Patent: Mar. 5, 1996

[54] DECORATIVE DEVICE WITH A SMOOTH OPAQUE MAGNETIC SURFACE FOR MAGNETS

[76] Inventors: Sharon L. Millard, 136 Giller Ave., Holbrook, N.Y. 11741; Bruce V. Hayes, 305 Richmond Blvd., Ronkonkama, N.Y. 11779

[21] Appl. No.: 368,713

[22] Filed: Jan. 3, 1995

Related U.S. Application Data

[63] Continuation of Ser. No. 45,739, Apr. 14, 1993, abandoned.

[51] Int. Cl.[6] ..... G09F 7/04

[52] U.S. Cl. ..... 40/621; 40/156; 428/14; 428/182

[58] Field of Search ..... 40/600, 621, 152, 40/156; 428/14, 182, 900

[56] References Cited

U.S. PATENT DOCUMENTS

| | | | |
|---|---|---|---|
| 1,395,982 | 11/1921 | Gee | 40/621 |
| 3,218,747 | 11/1965 | Cornfield | 40/152.1 |
| 3,456,373 | 7/1969 | Epton | 428/900 X |
| 3,786,584 | 1/1974 | Holson | 40/621 X |
| 3,928,921 | 12/1975 | Gurman | 40/621 X |
| 4,197,151 | 4/1980 | Muzik | 40/600 X |
| 4,242,823 | 1/1981 | Bruno | 40/621 |

*Primary Examiner*—Brian K. Green
*Attorney, Agent, or Firm*—Michael I. Kroll

[57] ABSTRACT

The present disclosure relates to a decorative device with a smooth opaque magnetic display surface for magnets. The decorative device with a smooth opaque magnetic display surface for magnets includes a frame member having a viewing opening and a recessed portion formed about the viewing opening in the rear side of the frame member, an opaque plate being sized to fit against the recessed portion in the opaque frame member, apparatus for securing the opaque magnetic plate to the frame member, an opaque backing panel being sized to fit against and be attached to the opaque magnetic plate, and apparatus for removably affixing the frame member to a vertical flat surface so that the magnets can be placed onto the opaque magnetic plate to be seen through the viewing opening in the frame member.

5 Claims, 2 Drawing Sheets

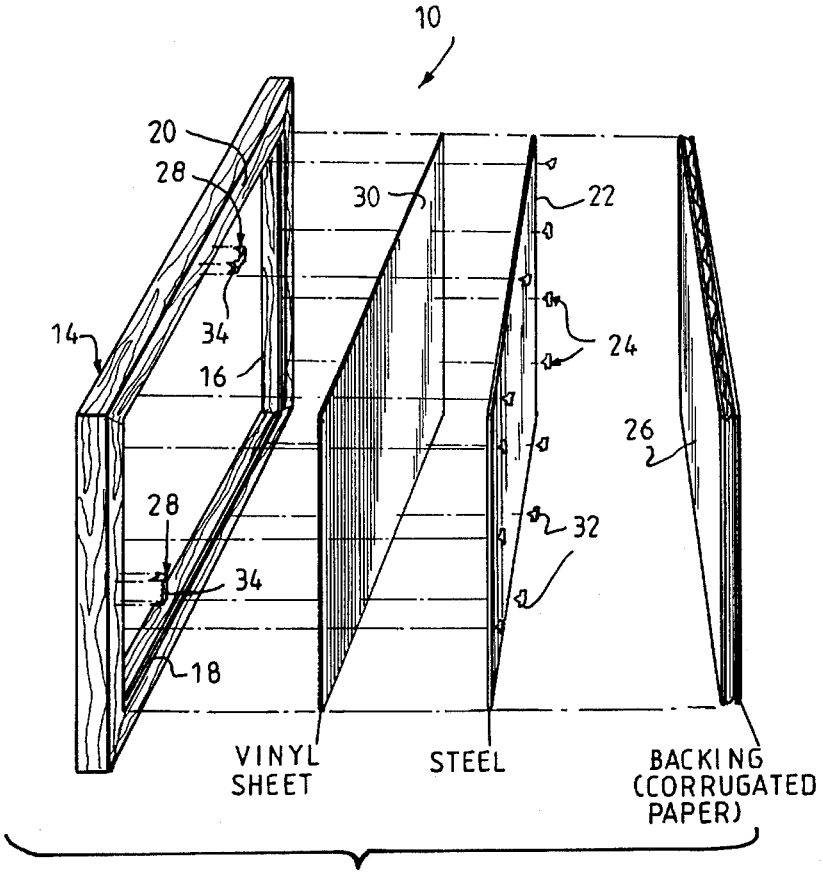
Fig. 4
Fig. 5
(PATRIOTIC MOTIF)
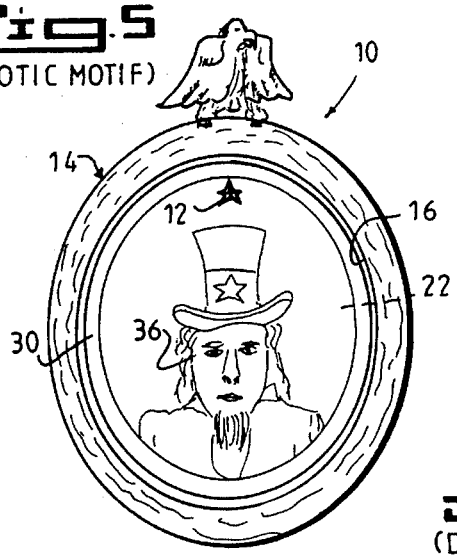
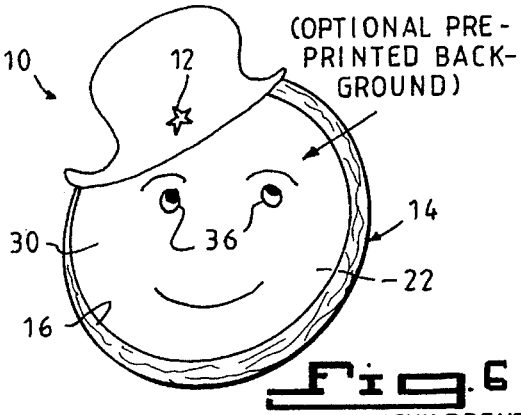
Fig. 6
(CHILDRENS MOTIF)
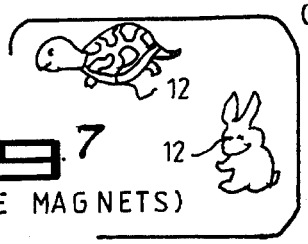
Fig. 7
(DECORATIVE MAGNETS)

DECORATIVE DEVICE WITH A SMOOTH OPAQUE MAGNETIC SURFACE FOR MAGNETS

This application is a continuation of our application Ser. No. 08/045,739 filed on Apr. 14, 1993, now abandoned.

BACKGROUND OF THE INVENTION

1. Field of the Invention

The instant invention relates generally to picture frames and more specifically it relates to a decorative device with a smooth opaque magnetic surface for magnets.

Kitchen magnets have been around for a long time and come in many different shapes, sizes and colors. These magnets are interesting to see and serves the dual purpose of holding notes and memos onto a refrigerator, as well as being pleasing to the eye. Some people even have large numbers of magnets in different configurations that are no longer manufactured. There is no way, however, to display the magnets other than putting them on the refrigerator, whereby they can be easily broken if they fall off, when the refrigerator door is opened and closed many times.

2. Description of the Prior Art

U.S. Pat. No. 4,242,823 to Bruno teaches that the magnetic material is a lightweight mesh screen or a sheet with closely spaced magnetic particles. However, the present invention teaches the use of one opaque solid sheet. The intended purpose of the patent to Bruno is for commercial use utilizing magnetized characters to create signs. However, the present invention is used for decorative purposes to be used by consumers. One of the most important features of the patent to Bruno is its translucency, to highlight the characters attached to it. However, the present invention is opaque, light is not intended to pass through the present invention, to accent the magnets attached to it. The patent to Bruno uses slots with expanding inserts to attach the surface to the frame. However, the present invention uses glazier points to attach the smooth flat opaque surface to the frame member. The patent to Bruno has no viewing opening or recesses as does the present invention. Furthermore, the device of the patent to Bruno has no exposed frame for decorative purposes. It only employs a frame for supporting the screen mesh internally.

U.S. Pat. No. 3,187,449 to Longo et al. teaches no magnetically attractive areas that are for the benefit of the end user. No magnetic devices are intended to be attached to the patent to Longo et al., it itself is intended to be attached to a magnetically attractive surface. The patent to Longo et al. teaches holding pictures for display inside a transparent plastic surface. However, the present invention teaches the direct displaying of objects on a smooth opaque magnetic surface.

U.S. Pat. No. 3,988,921 to Gurman relies on multi-level magnetic components. It is necessary to utilize all of the separate magnetic components to fulfill the function of the device of Gunman. However, the present invention is a decorative device while the device of Gurman is a teaching device which cannot be used universally with other magnetic devices not intended specifically for its single task.

Utilizing Gunman's teaching over Bruno's device would create an unsightly and highly irregular surface this would be unsuitable for Bruno's intended purposes and would not be decorative as is the present invention.

Numerous picture frames have been provided in prior art that are adapted to be hung on flat vertical surfaces for displaying paintings, photographs or the like, so that they can be viewed therefrom. While these units may be suitable for the particular purpose to which they address, they would not be as suitable for the purposes of the present invention as heretofore described.

SUMMARY OF THE INVENTION

The smooth opaque magnetic surface for magnets is like a picture frame with a thin, vinyl, opaque sheet laminated onto an opaque solid steel plate where the picture normally goes and is designed to provide a way for displaying favorite and unique magnets for people who collect magnets. It will help to prevent breakage of favorite magnets as well as keeping scratches off of the exterior of appliances where most magnets are now placed. This invention would be useful for people who have a collection of unique magnets that they would like to display.

A primary object of the present invention is to provide a smooth opaque magnetic surface for magnets that will overcome the shortcomings of the prior art devices.

Another object is to provide a smooth opaque display surface for magnets that would be useful for people who have a collection of unique magnets that they would like to display for viewing.

An additional object is to provide a smooth opaque display surface for magnets that will help prevent the breakage of favorite magnets as well as avoiding scratches on the exterior of appliances where most magnets are placed for viewing.

A further object is to provide a smooth opaque display surface for magnets that is simple and easy to use.

A still further object is to provide a smooth opaque display surface for magnets that is economical in cost to manufacture.

Further objects of the invention will appear as the description proceeds.

In keeping with these objects, and with others which will become apparent hereinafter, one feature of the present invention resides, briefly stated, in a decorative device with a smooth opaque magnetic display surface for magnets including a frame member having a viewing opening and a recessed portion formed about the viewing opening in the rear side of the frame member, an opaque plate being sized to fit against the recessed portion in the opaque frame member, means for securing the opaque magnetic plate to the frame member, an opaque backing panel being sized to fit against and be attached to the opaque magnetic plate, and means for removably affixing the frame member to a vertical flat surface so that the magnets can be placed onto the opaque magnetic plate to be seen through the viewing opening in the frame member.

In accordance with another feature of the present invention, it further includes an opaque non-magnetic sheet laminated onto the front surface of the opaque magnetic plate so that the magnets can be placed onto the opaque non-magnetic sheet and held thereto by the opaque magnetic plate.

Another feature of the present invention is that the securing means includes a plurality of glazier points, each of which is pressed into the rear side of the frame member of the recessed portion to hold the opaque magnetic plate thereto.

Yet another feature of the present invention is that the removably affixing device includes at least one picture hanger fastened into the rear side of the frame member so that the picture hanger can be hooked onto a fastener placed into the vertical flat surface.

Still another feature of the present invention is that the frame member is fabricated out of suitable material.

Yet still another feature of the present invention is that the opaque magnetic plate is fabricated out of opaque solid steel metal material.

Still yet another feature of the present invention is that the opaque backing panel is fabricated out of corrugated paper material.

Another feature of the present invention is that the opaque non-magnetic sheet is fabricated out of a vinyl material.

Yet another feature of the present invention is that the opaque non-magnetic sheet can include various types of decorative indicia printed thereon.

Still another feature of the present invention is that the opaque non-magnetic sheet can include decorative indicia for a child printed thereon.

Yet still another feature of the present invention is that the opaque non-magnetic sheet can include decorative indicia for an adult printed thereon.

Still yet another feature of the present invention is that the opaque non-magnetic sheet is fabricated out of a thin vinyl material.

Another feature of the present invention is that the frame is square shaped.

Yet another feature of the present invention is that the frame is rectangular shaped.

Still another feature of the present invention is that the frame is round shaped.

Yet still another feature of the present invention is that the frame is oval shaped.

Still yet another feature of the present invention is that the frame comes in a variety of sizes to match or meld with the decor of most any room in the house.

Another feature of the present invention is that the frame comes in a variety of colors to match or meld with the decor of most any room in the house.

Yet another feature of the present invention is that maps of tourist attractions could be superimposed on the opaque vinyl sheet that is laminated to the opaque solid steel plate so as to display places where a person has visited.

Still another feature of the present invention is that diagrams of tourist attractions could be superimposed on the opaque vinyl sheet that is laminated to the opaque solid steel plate so as to display places where a person has visited.

Yet still another feature of the present invention is that maps of theme parks could be superimposed on the opaque vinyl sheet that is laminated to the opaque solid steel plate so as to display places where a person has visited.

Still yet another feature of the present invention is that diagrams of theme parks could be superimposed on the opaque vinyl sheet that is laminated to the opaque solid steel plate so as to display places where a person has visited.

Another feature of the present invention is that maps of tourist attractions could be superimposed on the opaque vinyl sheet that is laminated to the opaque solid steel plate so as to help the person chart the route of an upcoming trip.

Yet another feature of the present invention is that diagrams of tourist attractions could be superimposed on the opaque vinyl sheet that is laminated to the opaque solid steel plate so as to help the person chart the route of an upcoming trip.

Still another feature of the present invention is that maps of theme parks could be superimposed on the opaque vinyl sheet that is laminated to the opaque solid steel plate so as to help the person chart the route of an upcoming trip.

Yet still another feature of the present invention is that diagrams of theme parks could be superimposed on the opaque vinyl sheet that is laminated to the opaque solid steel plate so as to help the person chart the route of an upcoming trip.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 4 is an exploded perspective view of the instant invention showing the various components thereof.

FIG. 5 is a front view of a first modification of the instant invention being a patriotic motif.

FIG. 6 is a front view of a second modification of the instant invention being a children's motif.

FIG. 7 is a front view showing two typical decorative magnets used on the instant invention.

DETAILED DESCRIPTION OF THE PREFERRED EMBODIMENTS

Figure 1:
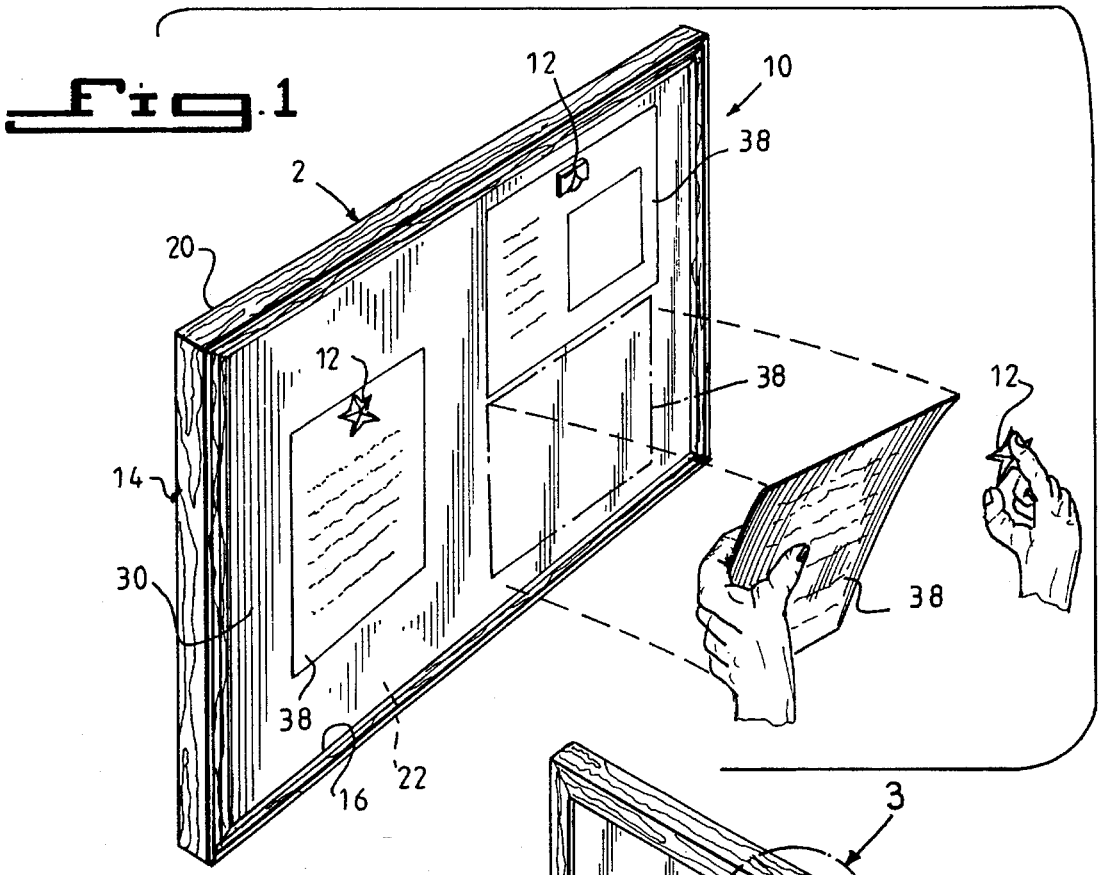
FIG. 1 is a front perspective view of the instant invention showing various papers being held thereto by magnets.
Figure 2:
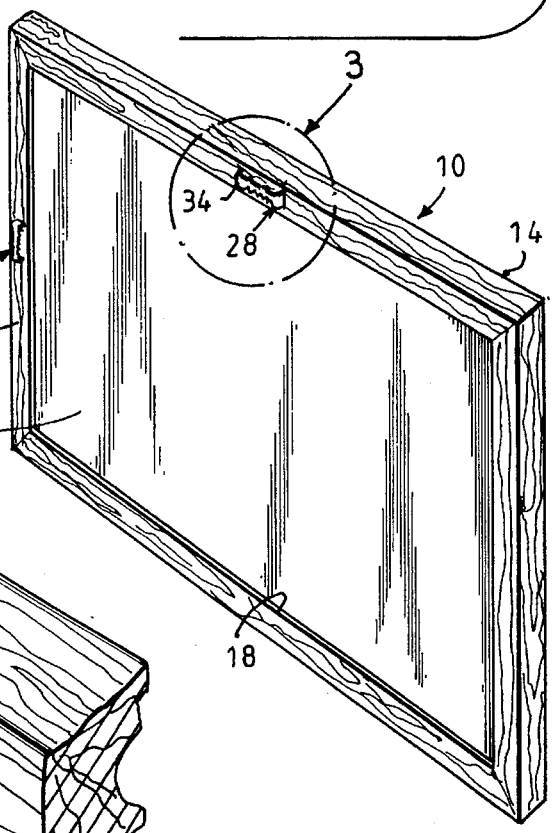
FIG. 2 is a rear perspective view taken in direction of arrow 2 in FIG. 1.
Figure 3:
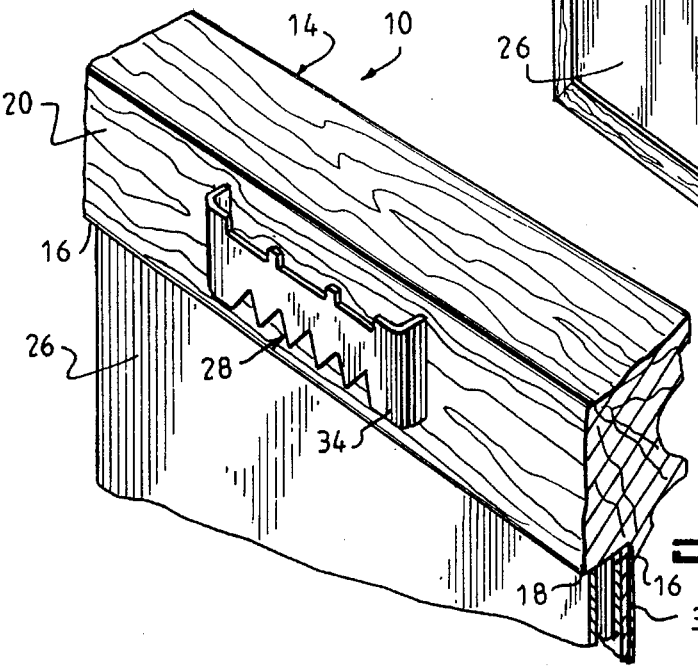
FIG. 3 is an enlarged perspective view as indicated by arrow 3 in FIG. 2, showing the picture hanger in greater detail.

Turning now descriptively to the drawings, in which similar reference characters denote similar elements throughout the several views, the Figures illustrate a smooth opaque display surface 10 for magnets 12 consisting of a frame member 14 having a viewing opening 16 and a recessed portion 18 formed about the viewing opening 16 on the reverse side of the frame 20. A smooth opaque magnetic plate 22 is sized to fit against the recessed portion 18 in the frame member 14, while fasteners 24 are for securing the smooth opaque magnetic plate 22 to the frame member 14. An opaque backing panel 26 is sized to fit against and be attached to the smooth opaque magnetic plate 22 and a mechanism 28 is for removably affixing the frame member 14 to a vertical flat surface, such as a wall, so that the magnets 12 can be placed onto the smooth opaque magnetic plate 22 to be seen through the viewing opening 16 in the frame member 14.

An opaque non-magnetic sheet 30 is laminated onto the front surface of the smooth opaque magnetic plate 22 so that the magnets 12 can be placed onto the opaque non-magnetic sheet 30 and held thereto by the smooth opaque magnetic plate 22.

The securing fasteners 24 includes a plurality of glazier points 32, each of which is pressed into the rear side 20 of the frame member 14 at the recessed portion 18 to hold the smooth opaque magnetic plate 22 thereto.

The removably affixing mechanism 28 includes two picture hangers 34, each fastened into the rear side 20 of the frame member 14 so that either picture hanger 34 can be hooked onto a fastener placed into the vertical flat surface.

The frame member 14 is fabricated out of wood or suitable material, the smooth opaque magnetic plate 22 is fabricated out of opaque solid steel metal material, the opaque backing panel 26 is fabricated out of corrugated paper material and the opaque non-magnetic sheet 30 is fabricated out of a thin vinyl material. In some instances the opaque non-magnetic sheet 30 can include various types of decorative indicia 36 printed thereon, as shown in FIGS. 5 and 6.

The frame member 14 can be square or rectangular, as shown in FIGS. 1 through 4, oval in FIG. 5 for a patriotic motif or round in FIG. 6 for a children's motif. Magnets 12 of FIG. 7 are an example of the decorative use of the invention.

The invention 10 would appeal to people who collect magnets 12 and don't have anywhere to safely display them. It would be a unique conversation piece and an added feature to any room. The smooth opaque display surface 10 could be manufactured in a variety of sizes and colors to match or meld with the decor of most any room in the house. Maps and diagrams of tourist attractions and theme parks could be superimposed on the vinyl sheet 30 that is laminated to the opaque solid steel plate 22, so as to display places where a person has visited. Such a display could also help the person chart the route of an upcoming trip or vacation.

Overall, the basic concept behind the invention 10 appears to be sound and the product idea workable. The basic materials are readily obtainable, and the concept of the smooth opaque display surface 10 for the magnets 12 is that it will allow a person to display collections of magnets 12 and it would add to the decor of their home.

To install the smooth opaque display surface 10 a person simply places a fastener, such as a nail, screw, etc. into the flat vertical surface. One of the hangers 34 can then be hooked onto the fastener. As best seen in FIG. 1, the magnets 12 can now be placed onto the non-magnetic opaque thin vinyl sheet 30 to be displayed therefrom and in some instances hold various papers 38, such as notes, letters, a calendar or the like thereto.

To remove the smooth opaque display surface 10, a person simply pulls the magnets 12 from the non-magnetic opaque thin vinyl sheet 30 and the papers 38 are taken away. The hanger 34 is then unhooked from the fastener in the flat vertical surface so that the smooth opaque display surface 10 can be put into storage for future use.

LIST OF REFERENCE NUMBERS

| | |
|---|---|
| 10 | smooth opaque display surface |
| 12 | magnet |
| 14 | frame member |
| 16 | viewing opening in 14 |
| 18 | recessed portion in 14 |
| 20 | rear side of frame member in 14 |
| 22 | smooth opaque magnetic plate |
| 24 | fastener |
| 26 | backing panel |
| 28 | removably affixing device |
| 30 | non-magnetic sheet |
| 32 | glazier point |
| 34 | picture hanger |
| 36 | decorative indicia |
| 38 | paper |

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A decorative device with a smooth opaque magnetic display surface in combination with magnets comprising:

a) an opaque frame member with a front side and a rear side having a viewing opening and a recessed portion formed about the viewing opening in the rear side of the frame member;

b) an opaque magnetic plate of solid steel fitted against the recessed portion in said opaque frame member;

c) means for securing said opaque magnetic plate of solid steel to said frame member comprising a plurality of glazier points, each of which is pressed into the rear side of said frame member of the recessed portion to hold said opaque magnetic plate of solid steel thereto;

d) opaque backing panel means of corrugated paper material fitted against and attached to said opaque magnetic plate of solid steel facing the rear side of said frame member and enclosing said glazier points so that said glazier points are between said magnetic plate of solid steel and said opaque backing panel when said device is assembled for use;

e) means for removably affixing said frame member to a vertical flat surface so that the magnets can be placed onto said opaque magnetic plate of solid steel facing the front side of said frame member to be seen through the viewing opening in said frame member, said removably affixing means including at least one picture hanger fastened into the rear side of said frame member so that said picture hanger can be hooked onto a fastener placed into the vertical flat surface; and f) an opaque non-magnetic sheet of thin vinyl material laminated onto said opaque magnetic plate of solid steel facing the front side of said frame member so that the magnets can be placed onto said opaque non-magnetic sheet of thin vinyl material and held thereto by said opaque magnetic plate of solid steel, said sheet of thin vinyl material having decorative indicia thereon.

2. A decorative device as recited in claim 1, wherein said frame member is square shaped.

3. A decorative device as recited in claim 1, wherein said frame member is rectangular shaped.

4. A decorative device as recited in claim 1, wherein said frame member is round shaped.

5. A decorative device as recited in claim 1, wherein said frame member is oval shaped.

* * * * *